United States Patent [19]

Pascale

[11] Patent Number: 4,962,822

[45] Date of Patent: Oct. 16, 1990

[54] DOWNHOLE DRILL BIT AND BIT COUPLING

[75] Inventor: Jack H. Pascale, Bloomsbury, N.J.

[73] Assignee: Numa Tool Company, Thompson, Conn.

[21] Appl. No.: 451,301

[22] Filed: Dec. 15, 1989

[51] Int. Cl.[5] ..... E21B 10/26; E21B 10/66

[52] U.S. Cl. ..... 175/258; 175/262; 175/292; 175/415; 408/180; 408/188

[58] Field of Search ..... 175/171, 257, 258, 262, 175/321, 292, 389, 406, 415; 408/150, 180, 187, 188

[56] References Cited

U.S. PATENT DOCUMENTS

| | | | |
|---|---|---|---|
| 3,174,563 | 2/1963 | Edbom et al. | 175/258 |
| 3,416,616 | 3/1967 | Ahlgren | 175/258 |
| 3,648,789 | 3/1972 | Ericksson | 175/292 |
| 3,753,470 | 8/1973 | Lagerstrom et al. | 175/292 |
| 3,848,683 | 11/1974 | Persson | 175/65 |
| 3,870,114 | 3/1975 | Pulk et al. | 175/258 |
| 4,408,669 | 10/1983 | Wiredal | 175/258 |
| 4,440,244 | 4/1984 | Wiredal | 175/292 |
| 4,545,443 | 10/1985 | Wiredal | 175/258 |
| 4,620,600 | 11/1986 | Persson | 175/73 |
| 4,770,259 | 9/1988 | Jansson | 175/258 |
| 4,836,306 | 6/1989 | Barrows | 175/415 X |

*Primary Examiner*—Stephen J. Novosad
*Assistant Examiner*—David J. Bagnell
*Attorney, Agent, or Firm*—Chilton, Alix & Van Kirk

[57] ABSTRACT

A downhole impact drill having a drill bit head with a drill bit sector for drilling an enlarge hole upon rotation of the drill. The bit is mounted within a chuck for movement between a retracted, working position in which the bit is coaxially mounted for drilling and an extended, non-working position in which the bit is loosely mounted within the chuck to permit the bit to swing laterally to reduce the diameter of the drill bit head envelope. In its extended, non-working position, the bit is supported on the chuck at a 3° angle at which the drill bit sector is positioned inwardly to facilitate installation and withdrawal of the drill.

19 Claims, 7 Drawing Sheets

DOWNHOLE DRILL BIT AND BIT COUPLING

SUMMARY OF THE INVENTION

The present invention relates generally to downhole drills having notable utility in drilling enlarged holes for overburden casings and relates more particularly to a new and improved drill bit and drill bit coupling for such downhole drills.

A principal object of the present invention is to provide a new and improved drill bit and drill bit coupling which are useful in drilling enlarged holes for overburden casings and which permit installation and withdrawal of the bit through the internal bore of the overburden casing.

Another object of the present invention is to provide a new and improved downhole drill bit having in a retracted or working position thereof a relatively large working diameter and in an extended or non-working position thereof a relatively small diameter envelope facilitating installation of the bit into and withdrawal of the bit from the drilled hole.

A further object of the present invention is to provide a new and improved impact drill bit which fulfills one or more of the foregoing objects of the present invention and which has an impact head with an integral impact bit sector for impact drilling an enlarged hole as the impact bit is rotated during drilling. In accordance with an additional object of the present invention, the body of the impact drill bit forming the body of both the impact head and an impact head drive shank, is a one-piece, integrally formed part and the impact head comprises a leading, pilot impact bit for drilling a relatively small diameter guide hole and a trailing, impact bit sector for drilling a substantially larger diameter hole as the bit is rotated during drilling.

A further object of the present invention is to provide a new and improved drill bit coupling for a downhole drill for coupling a drill bit in a new and improved manner which provides for positioning the bit either in a relatively large diameter, working position for drilling a hole in a conventional manner or in a non-working position having a relatively small diameter envelope which facilitates installing the bit into and withdrawing the bit from the drilled hole. In accordance with an additional object of the present invention, the bit in its working position is operable for drilling a relatively large diameter hole for an overburden casing and in its non-working position can be installed and withdrawn through the smaller diameter bore of the overburden casing.

A further object of the present invention is to provide a new and improved downhole drill bit which fulfills one or more of the foregoing objects of the present invention, which is useful in downhole impact drilling and which has an economical design that can be manufactured at relatively low cost.

Other objects will be in part obvious and in part pointed out more in detail hereinafter.

A better understanding of the invention will be obtained from the following detailed description and accompanying drawings of preferred embodiments of the present invention.

DESCRIPTION OF PREFERRED EMBODIMENTS

Figure 6:
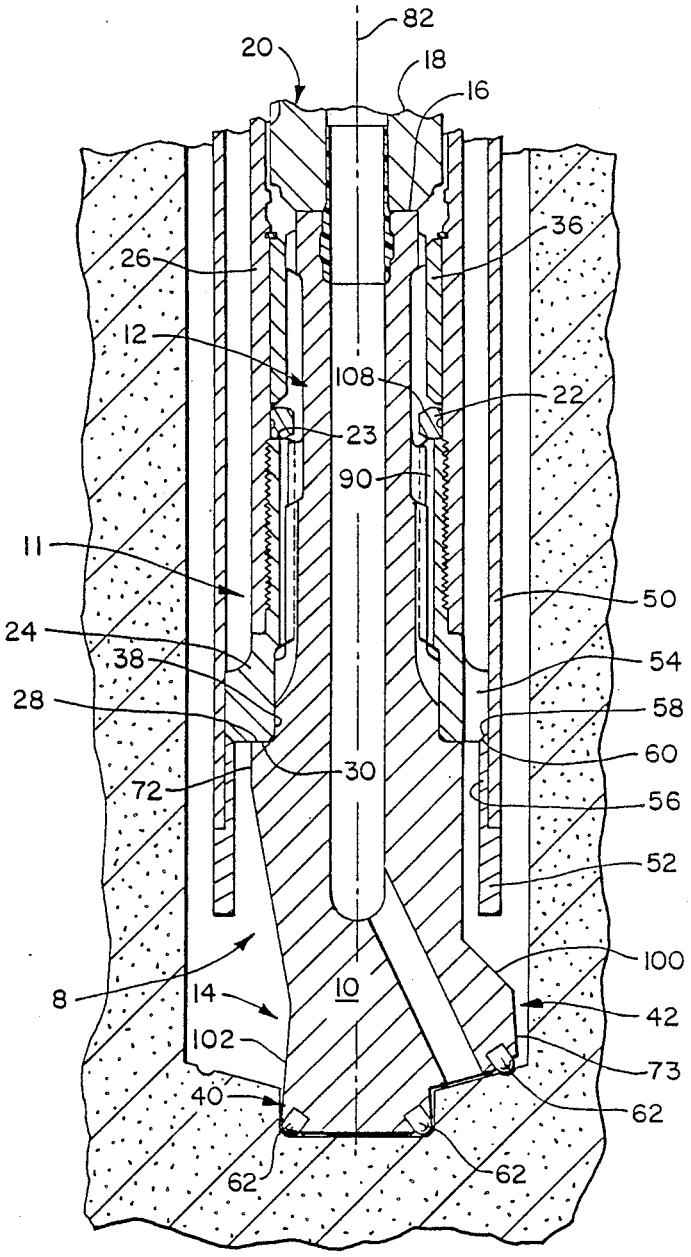
FIG. 6 is a partial longitudinal section view, partly broken away and partly in section, of a downhole impact drill installation employing the impact bit of FIG. 1 and an impact bit coupling incorporating the present invention.
Figure 7:
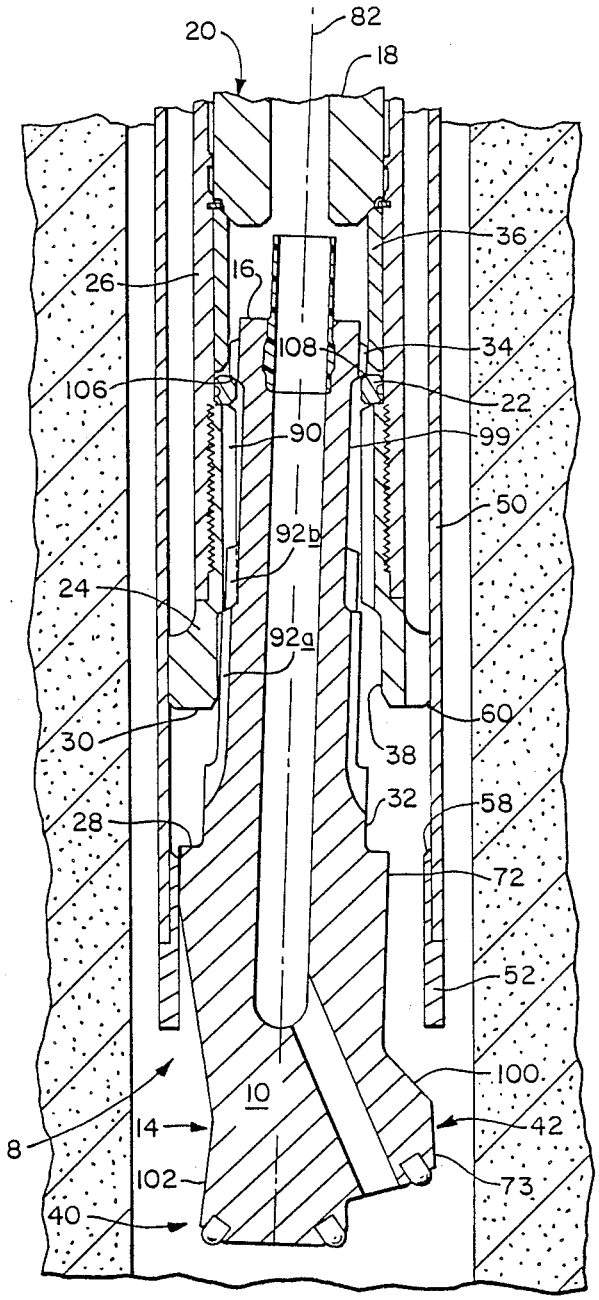
FIGS. 7 and 8 are longitudinal section views, partly broken away and partly in section, of the installation of FIG. 6 showing the downhole impact drill in first and second stages of withdrawal from a drilled hole.
Figure 8:
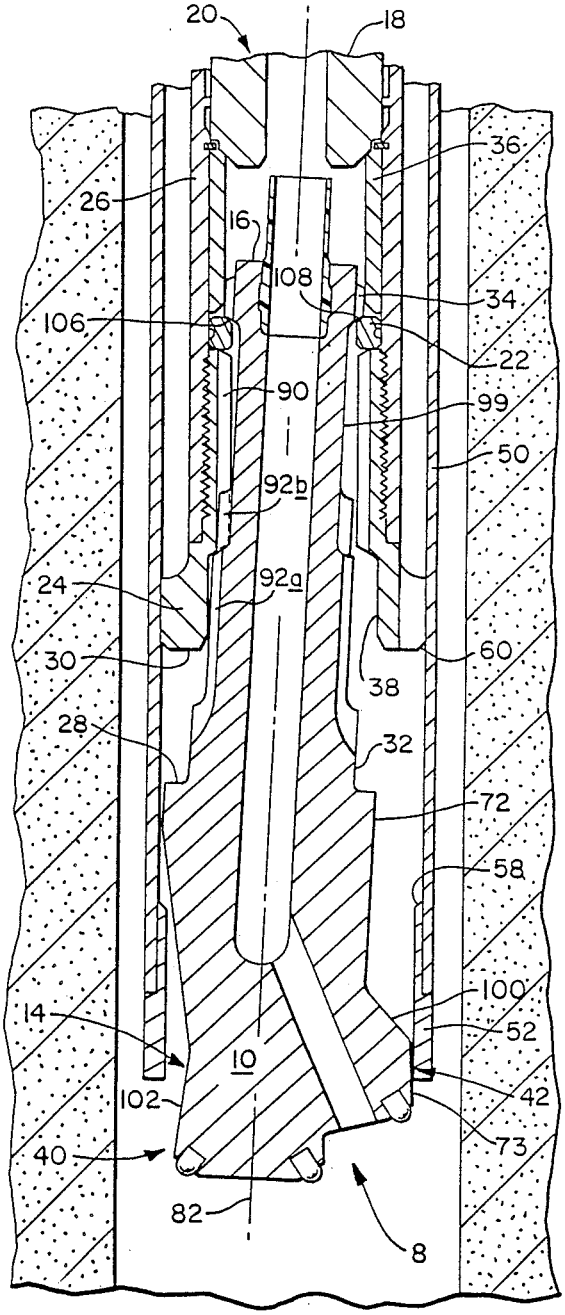

Referring now to the drawings in detail, wherein like numerals are used to designate the same or like parts, and referring particularly to FIGS. 6–8, a pneumatic, downhole impact drill 8 is shown which employs a drill bit 10 and drill bit coupling 11 incorporating the present invention. The drill bit 10 has a rear, elongated drive shank 12 and a front, enlarged drill bit impact head 14. The elongated body of the bit 10, comprising the body of both the drive shank 12 and impact head 14, is preferably a one-piece, integrally formed part which is manufactured by machining a suitable length of large diameter bar stock or forging.

A downhole hammer 20 of the drill 8 is shown only in part in FIGS. 6–8. Except as specifically described hereinafter, the downhole hammer 20 may be like that shown and described in U.S. Pat. No. 4,530,408, dated July 23, 1985 and entitled "Porting System for Pneumatic Impact Hammer". Referring to FIGS. 6–8 and to U.S. Pat. No. 4,530,408 (which is incorporated herein by reference), the drive shank 12 of the bit 10 is mounted in the front end of the hammer 20 so that an impact piston 18 of the hammer 20 can be pneumatically reciprocated in a conventional manner to impact a rear anvil end face 16 of the drive shank 12 at a high frequency for downhole impact drilling.

The bit 10 is axially shiftable within the front end of the downhole hammer 20 between an inner or retracted, working position shown in FIG. 6 and an outer or extended, non-working position shown in FIGS. 7 and 8. In the extended, non-working position of the bit 10, the drive shank 12 is supported, by means of a bit retaining ring 22, on a rear annular end face 23 of an externally threaded chuck or sleeve 24 screwed into the front end of the hammer casing 26. In the retracted, working position of the bit 10, a rear annular shoulder 28 of the impact head 14 and a front annular end face 30 of the chuck 24 are in engagement. Thus, the chuck 24 and retaining ring 22 together support and retain the drill bit 10 within the hammer 20. As will be understood from the following description, the bit coupling 11 is formed by the cooperating parts of the bit 10, chuck 24 and retaining ring 22.

The bit 10 is removed from the hammer 20 by unscrewing the chuck 24 from the hammer casing 26, removing the subassembly comprising the bit 10, chuck 24 and retaining ring 22, removing the two semi-circular halves of the split retaining ring 22 from the drive shank 12 and then removing the bit 10 from the chuck 24.

In the retracted, working position of the bit 10, the impact bit 10 is coaxially mounted within the chuck 24 and impact hammer 20. Enlarged, front and rear guide sections 32, 34 of the shank 12 assist in positioning the bit 10 coaxially within the chuck 24. The front guide section 32 is received within an enlarged, front coaxial bore 38 of the chuck 24 to coaxially position the front end of the bit 10. The rear guide section 34 cooperates with a bearing sleeve 36 mounted within the hammer casing 26 to coaxially position the rear end of the bit 10. Also, the chuck 24 and bit drive shank 12 have cooperating internal and external splines 90, 92 (described more fully hereinafter) which assist in coaxially positioning the bit 10 within the hammer 20 with the bit 10 in its retracted, working position.

The drill bit head 14 comprises a leading, pilot impact bit 40 and a trailing, impact bit sector 42 which is largely located on one side of the bit axis 82 (i.e., on one side of a diametral plane). In the shown embodiment, the body of the impact bit sector 42 is integrally formed with the body of the pilot bit 40. (Also, as previously indicated, the entire body of the bit 10, comprising the body of both the shank 12 and impact head 14, is preferably provided by a one-piece integrally formed part.)

The pilot bit 40 produces a pilot or guide hole for the drill 8. The trailing drill bit sector 42 produces an enlarged hole as the impact drill 8, including the bit 10, is rotated in a conventional manner during drilling. The drill bit sector 42 has an outer diameter substantially greater than that of the pilot bit 40. For example, when the bit 10 is used with a standard size hammer 20 having an outside diameter of 5⅜ inches, the pilot bit 40 is dimensioned to produce a pilot hole having a diameter of approximately three and one-half (3½) inches and the drill bit sector 42 is dimensioned to enlarge the pilot hole to a diameter of approximately seven and one-half (7½) inches.

Referring to FIG. 6, the bit 10 is particularly useful in drilling an enlarged hole for an overburden casing 50. In a generally conventional manner, the overburden casing 50 is fed into the hole during drilling. For that purpose, a drive shoe 52 is welded to the front end of the overburden casing 50 and the drill chuck 24 is formed with a plurality of peripheral, integral drive lugs 54 (of which there are four in the disclosed embodiment) for engagement with the rear end of the drive shoe 52. The drive lugs 54 are slidable within the overburden casing 50 into engagement with the rear end of the drive shoe 52. Specifically, a drive shoe sleeve 56 received in the overburden casing 50, has a rear, tapered end shoulder 58 which is engageable by conforming, tapered, peripheral shoulders 60 of the drive lugs 54. Accordingly, as seen in FIG. 6, as the impact drill 8 is fed into the drilled hole, the overburden casing 50 is fed into the hole immediately behind the drill bit sector 42.

Figure 4:
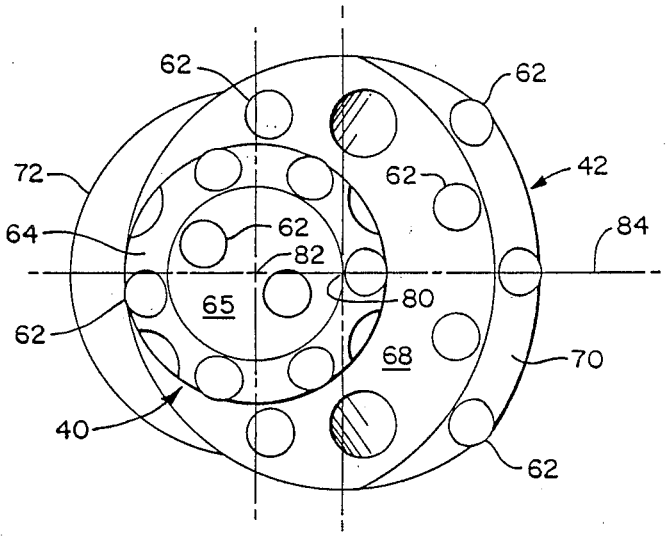
FIG. 4 is an enlarged front end view of the bit of FIG. 1.

Suitable carbide impact buttons 62 (mounted within bores in the body of the impact head 14) are provided on the working faces of the pilot bit 40 and impact bit sector 42 as shown in FIG. 4. An annular arrangement of six equiangularly spaced impact buttons 62 is provided on a peripheral conical working face 64 of the pilot bit 40. Two diametrically opposed impact buttons 62 are provided at different radii on a central flat end face 65 of the pilot bit 40. The drill bit sector 42, at its inner perimeter, has a conical working face 68 which extends nearly completely around the pilot bit 40 and, at its outer perimeter, has a conical working face 70 which extends approximately one hundred twenty degrees (120°) around the pilot bit 40. Four impact buttons 62 are provided at two different radii on the inner conical working face 68, located symmetrically relative to the radial centerline 84 of the bit sector 42 along an arc of approximately one hundred eighty degrees (180°). Three buttons 62 are provided on the outer conical working face 70, with one button 62 located on the centerline 84 and the remaining two buttons 62 located symmetrically relative to the centerline 84 and approximately eighty degrees (80°) apart.

The drive shank 12 and a rear cylindrical section 72 of the enlarged drill bit head 14 are machined coaxial with the bit 10. The cylindrical surface of the rear cylindrical section 72 extends axially forwardly along that part of the drill bit head 14 which is aligned with the drill bit sector 42. The central flat end face 65 and peripheral conical working face 64 of the pilot bit 40 are machined coaxially with the bit. The conical working faces 68 and 70 of the drill bit sector 42 and the surface between the working faces 68, 70 of the drill bit sector 42 and pilot bit 40 are machined coaxial with the bit. The outer surface 73 of the drill bit sector 42, which extends approximately eighty degrees (80°) around the pilot bit 40, is machined coaxial with the bit 10. The remaining surfaces of the impact head body are machined about an offset axis 80 which is parallel to the bit axis 82 and offset from the bit axis along the radial centerline 84 of the bit sector 42. The impact head 14 is machined in steps. First, the bit 10 is machined about the bit axis 82 to produce the described coaxial surfaces. Thereafter, the impact head 14 is machined about the offset axis 80 to produce the non-coaxial surfaces of the impact head body.

Figure 1:
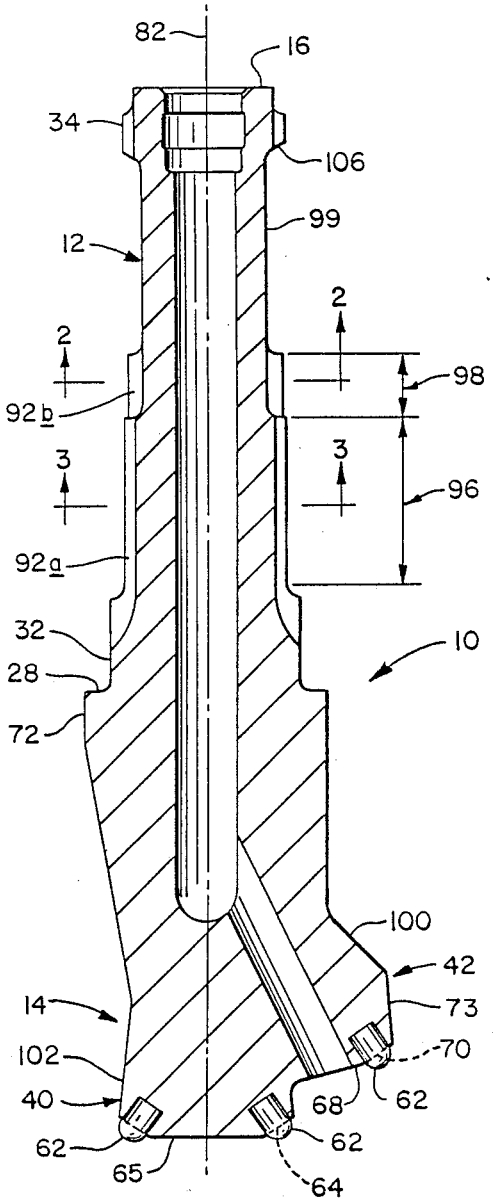
FIG. 1 is a longitudinal section view, partly in section, of a downhole impact bit incorporating the present invention.
Figure 2:
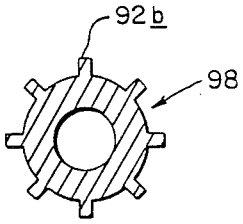
FIGS. 2 and 3 are transverse section views, in section, of the bit of FIG. 1 taken substantially along lines 2—2 and 3—3 of FIG. 1.
Figure 3:
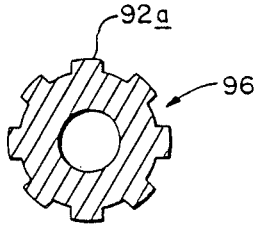
Figure 5:
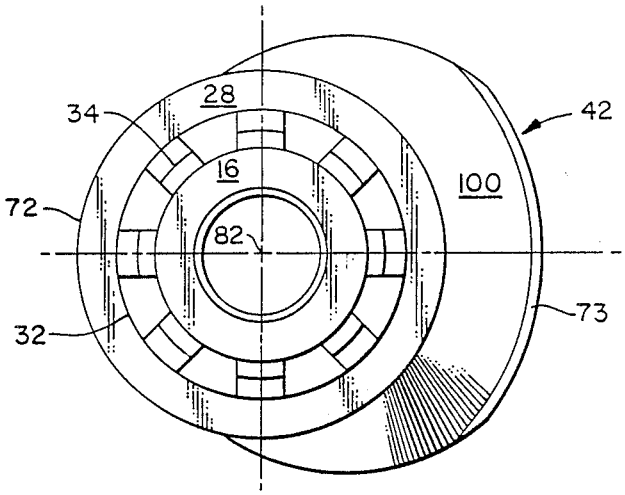
FIG. 5 is an enlarged rear end view of the bit of FIG. 1.

The chuck 24 and bit drive shank 12 have respective internal and external, cooperating splines 90, 92. In the shown embodiment, the chuck 24 and drive shank 12 each have eight equiangularly spaced, parallel, axial splines. Referring to FIGS. 1–3, the eight external splines 92 of the drive shank 12 are composed of primary and secondary, preferably contiguous, spline sections 96, 98 having different size spline segments. The spline segments 92*a* of the front or primary spline section 96 have larger outer and root diameters and a greater circumferential thickness than the spline segments 92*b* of the rear or secondary spline section 98.

The primary spline segments 92*a* are substantially longer than the secondary spline segments 92*b* as best shown in FIG. 1. The primary spline segments 92*a* are received between the internal splines 90 of the chuck 24 when the bit 10 is in its retracted, working position shown in FIG. 6. In that position of the bit 10, the spline segments 92*a* cooperate with the internal splines 90 of the chuck 24 to provide a drive coupling for rotating the bit 10 during drilling in a conventional manner. The primary spline segments 92*a* and internal splines 90 are mating splines having the same thickness and are sized to provide a rigid drive coupling and to assist in positioning the bit 10 coaxially within the hammer 20. The primary spline segments 92*a* have a reduced height which is less than the conventional spline height of the internal splines 90.

The rear guide section 34 of the drive shank 12 is formed with splines aligned with and having substantially the same size as the primary splines 92*a* to permit insertion and withdrawal of the rear guide section 34 through the chuck 24. A reduced, elongated rear end section 99 of the drive shank 12 is provided between the rear spline segments 92*b* and rear guide section 34. That rear end section 99 has a diameter equal to the root diameter of the rear spline segments 92*b*. The enlarged front end bore 38 of the chuck 24 has a diameter somewhat greater than the outer diameter of the primary splines 92*a*.

With the bit in its extended, non-working position shown in FIGS. 7 and 8, only the rear, secondary spline segments 92*b* are received between the internal splines 90 of the chuck 24. In that extended position of the bit 10, the secondary spline segments 92*b* cooperate with the internal splines 90 of the chuck 24 to provide a loose drive coupling which prevents rotation of the bit 10 within the chuck 24 and thereby maintain the angular orientation of the bit 10 within the chuck 24. Also, the reduced rear end section 99, reduced rear spline section 98 and reduced height of the primary spline segments 92*a* of the drive shank 12 and the enlarged front end bore 38 of the chuck 24 are sized to permit limited lateral play or movement of the bit 10 within the chuck 24. As shown in FIGS. 7 and 8, with the bit 10 in its extended, non-working position, the front guide section 32 of the drive shank 12 is forward of the chuck 24 to free the front end of the bit 10 for lateral movement. Also, with the bit 10 in that extended position, because there is a slight clearance and only a short axial overlap between the rear guide section 34 and the bearing sleeve 36, the bit 10 is free to swing or pivot laterally within the chuck 24 about its rear end.

In the disclosed embodiment, the bit 10 is free to swing or pivot approximately three degrees (3°) from its coaxial or working position shown in FIG. 6. That available play or movement permits the drill bit sector 42 to swing inwardly to reduce the diameter of the envelope of the enlarged drill head 14 and thereby enable the head 14 to be withdrawn through the overburden casing drive shoe 52. With the bit 10 free to swing within the chuck 24 as described, the bit 10 can be installed and withdrawn through the overburden casing 50 and drive shoe 52 and therefore through an opening substantially less that the diameter of the drilled hole.

Installation and withdrawal of the bit 10 through the overburden casing 50 and drive shoe 52 is accommodated automatically upon installation of the drill 8 into and withdrawal of the drill 8 from the casing 50. Upon initial withdrawal of the drill 8, the bit 10 shifts outwardly to its extended, non-working position due to gravity. Further withdrawal of the drill 8 withdraws the bit 10 through the drive shoe 52 and overburden casing 50. In the extended position of the bit 10, the drill bit head 14 is free to swing within the chuck 24 sufficiently to clear the drive shoe 52. The tapered rear face 100 of the drill bit sector 42 and the opposing peripheral tapered surface 102 of the drill head 14 assist in guiding the drill head 14 upwardly through the reduced diameter opening of the drive shoe 52. The lateral freedom of movement of the bit 10 also accommodates installation of the drill bit 10 through the overburden casing 50 and drive shoe 52. When lowering the drill, after the bit 10 engages the bottom of the hole, the bit 10 is retracted to its working position from its extended, non-working position. As the bit 10 is retracted, the bit is automatically swung into coaxial position by the interaction of the external splines 92 of the drive shank 12 with the internal splines 90 of the chuck 24. Specifically, the primary external spline segments 92*a* cooperate with the internal splines 90 of the chuck 24 and with the tapered shoulder at the front end of the internal splines 90 to swing the bit 10 into coaxial position as the bit is retracted into the chuck 24.

In place of the secondary spline segments 92*b*, other means (not shown) could be used to assist in orienting the bit 10 for retraction to its working position. For example, the front ends of the internal splines 90 of the chuck 24 and the rear ends of the primary spline segments 92*a* could be specially contoured for engagement for both angularly orienting the bit and assisting in coaxially orienting the bit for retraction to its working position.

In the extended, non-working position of the bit 10, the bit 10 is supported on the bit retainer ring 22 by a front, intermittent, but generally annular shoulder 106 of the rear guide section 34. Referring to FIGS. 7 and 8, the bit support shoulder 106 is machined for supporting the bit 10 at an angle having the desired inclination to the hammer axis. In the described embodiment, the annular support shoulder 106 is machined about an axis inclined three degrees (3°) to the axis of the bit 10. Therefore, when the support shoulder 106 engages the mating shoulder 108 of the retainer ring 22, the bit 10 is automatically swung three degrees (3°) from the hammer axis. In that angled position of the bit 10, the offset machined surfaces of the drill bit sector 42 are approximately coaxial with the chuck 24 (i.e., the offset machining axis 80 crosses the chuck axis approximately at the transverse plane of the bit sector 42) and such that the diameter of the drill bit head envelope is substantially less than when the bit 10 is in its retracted, working position. To swing the bit 10 in the appropriate direction, the axis of the annular support shoulder 106 is inclined away from the bit axis in the direction of the radial centerline 84 of the drill bit sector 42. In other words, the support shoulder 106 is machined at an angle to swing the drill bit sector 42 radially inwardly along the radial centerline 84 when the support shoulder 106 engages the retainer ring 22.

Figure 9:
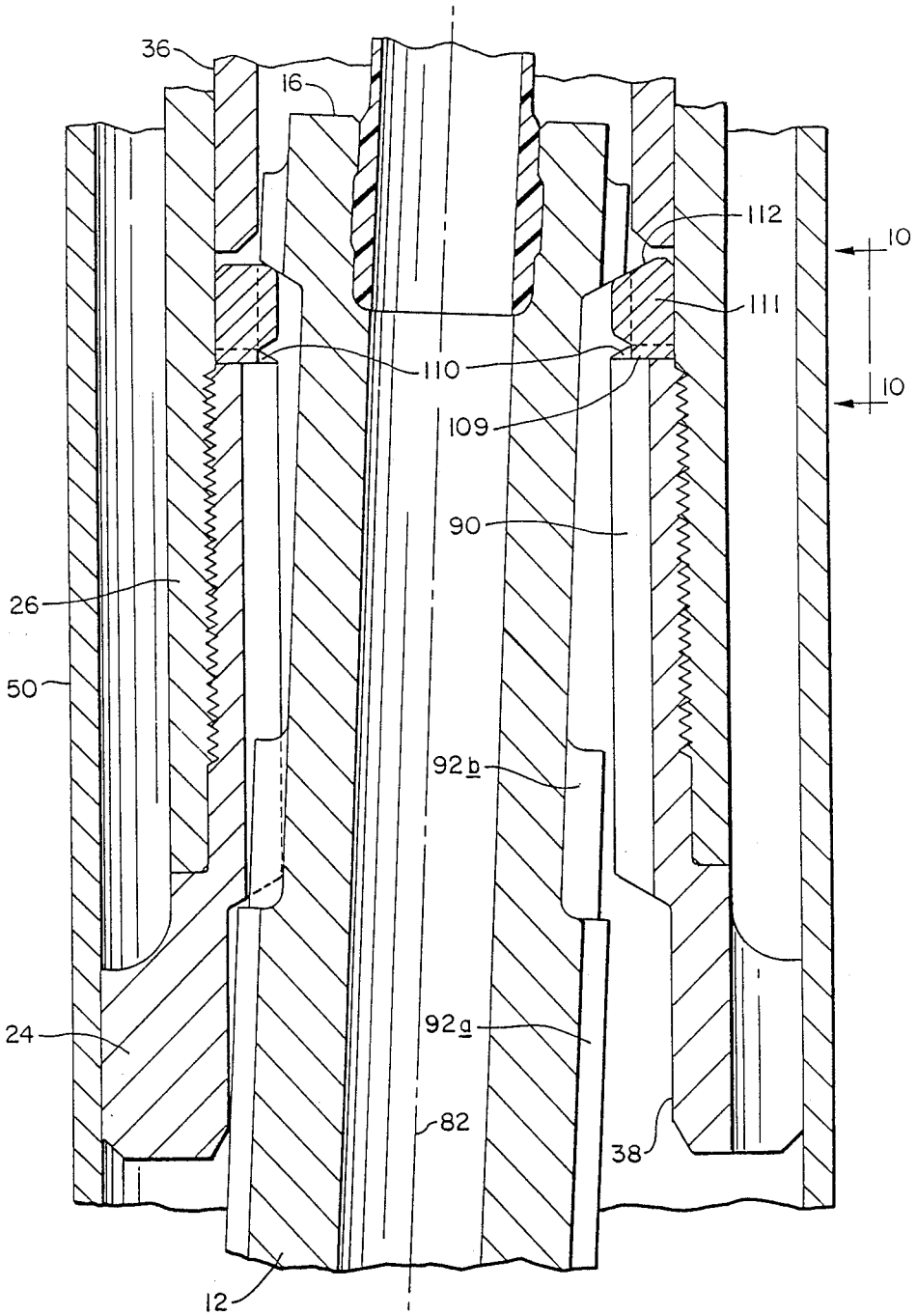
FIG. 9 is a partial longitudinal section view, partly broken away and partly in section, of a downhole impact drill employing modified embodiments, incorporating the present invention, of the impact bit and impact bit coupling of FIGS. 6–8.
Figure 10:
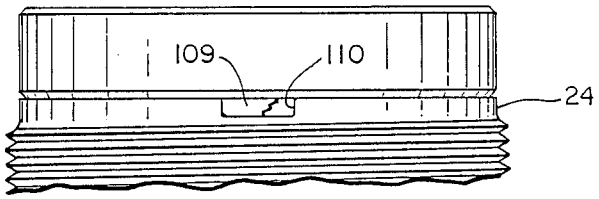
FIG. 10 is a partial longitudinal view, partly broken away, of the downhole impact drill of FIG. 9, taken in the direction of arrows 10—10 of FIG. 9 and showing a chuck and bit retainer ring of the drill.

Instead of providing an angled support shoulder 106 on the guide section 34 as described, (a) the rear end face 23 of the chuck or (b) the mating rear annular support shoulder 108 of the retainer ring 111 could be machined at that same angle as shown by the angled surface 112 in FIG. 9. In each of those alternatives, the bit 10 must be properly oriented relative to the chuck 24 for swinging the drill bit sector 42 inwardly as described. In addition, in the latter alternative shown in FIGS. 9 and 10, the retainer ring 111 must be properly oriented relative to the chuck. For that reason, the retainer ring 111 is keyed to the chuck 24 by one or more integral keys 109 received within corresponding slots 110 in the rear end face 23 of the chuck 24 as shown in FIG. 10.

As will be apparent to persons skilled in the art, various modifications, adaptations and variations of the foregoing specific disclosure can be made without departing from the teachings of the present invention.

I claim:

1. For use in a downhole drill subassembly comprising a chuck with an axial bore, with an annular arrangement of internal splines, and front and rear axial end faces at the opposite ends thereof and an elongated downhole drill bit having an enlarged front impact head and an elongated rear drive shank, with an annular arrangement of external splines, slidably received in the axial bore of the chuck for axial movement of the bit between a retracted, working position with the impact head in engagement with the front end face of the chuck and an extended, non-working position with the bit supported on the rear end face of the chuck; a downhole hammer drill bit having said enlarged front impact head and said elongated rear drive shank, the drive shank having a rear anvil end face adapted to be impacted for downhole impact drilling and said annular arrangement of external splines comprising a front section of primary spline segments for rotation of the bit in its retracted, working position, and rear section of secondary spline segments for preventing relative rotation of the bit in its extended, non-working position, the impact head having a leading, pilot impact bit and a trailing, impact bit sector coaxial with the pilot bit and largely on one side of the axis thereof, the pilot bit and bit sector providing for impact drilling guide and enlarged holes respectively, the drive shank having means, which includes the front section of primary spline segments, for coaxially positioning the bit in its retracted, working position and means, which includes the rear section of secondary spline segments, providing a loose coupling which permits lateral movement of the drive shank in the extended, non-working position of the bit, thereby to permit the impact bit sector to swing inwardly to reduce the diameter of the impact head envelope.

2. A downhole drill bit according to claim 1 wherein the rear section of secondary spline segments has a root diameter and outer diameter less than that of the front section of primary spline segments.

3. A downhole drill bit according to claim 1 wherein the drive shank has an enlarged rear end section with a front, generally annular shoulder for supporting the bit in its extended non-working position, the front generally annular shoulder having an axis inclined to the axis of the bit in the direction of the impact bit sector for supporting the impact bit at an angle at which the impact bit sector is radially inward of its working position to reduce the diameter of the impact head envelope.

4. A downhole hammer drill according to claim 3 wherein the front generally annular shoulder has an axis inclined approximately 3° to the axis of the bit.

5. A downhole drill bit according to claim 1 wherein the drive shank comprises an elongated section rearward of the rear section of secondary spline segments having a diameter less than the root diameter of the front section of primary spline segments.

6. A downhole drill bit according to claim 1 wherein the drive shank comprises an enlarged front generally cylindrical section between the impact head and front section of primary spline segments for assisting in coaxially positioning the bit in its retracted working position.

7. A downhole hammer impact bit having an enlarged front impact head and a rear elongated drive shank with a rear anvil end face adapted to be impacted for downhole impact drilling, the elongated drive shank having a set of external splines comprising a front section of primary spline segments for rotation of the bit during drilling with the bit in a retracted, coaxial, working position and a rear section of secondary spline segments, having a size less than the primary spline segments, for preventing rotation of the bit in an extended, non-working position thereof, the impact head having a leading, coaxial pilot impact bit and a trailing impact bit sector integral and coaxial with the pilot bit and largely on one side of the axis thereof, the pilot bit and impact bit sector providing, with the bit in its retracted, coaxial working position and upon rotation of the impact bit during drilling, for impact drilling guide and enlarged holes respectively, the impact bit having means, which includes the front section of primary spline segments, for coaxially positioning the bit in its retracted, working position and having means, which includes the rear section of secondary spline segments, for permitting lateral movement of the drive shank in the extended, non-working position of the bit, thereby to permit the impact bit sector to swing inwardly to reduce the diameter of the impact head envelope for installation and withdrawal of the impact bit.

8. A downhole hammer impact bit according to claim 7 wherein the secondary spline segments have a root diameter, outer diameter and circumferential thickness less than that of the primary spline segments to permit said lateral movement of the drive shank.

9. A downhole hammer impact bit according to claim 7 wherein the impact bit drive shank has an enlarged rear end section with a front, generally annular shoulder for supporting the bit in its extended non-working position, the front generally annular shoulder having an axis inclined to the axis of the bit in the direction of the impact bit sector for supporting the impact bit at an angle at which the impact bit sector is radially inward of its working position to reduce the diameter of the impact head envelope.

10. A downhole hammer impact bit according to claim 7 wherein the drive shank comprises an enlarged front generally cylindrical section between the impact head and front section of primary spline segments for assisting in coaxially positioning the bit in its retracted, working position.

11. A downhole hammer bit having an enlarged front drill bit head and a rear elongated drive shank having a front section of external splines and a rear reduced section, the front section of external splines providing part of a drive coupling for rotation of the bit during drilling with the bit in a retracted, coaxial, working position thereof, the drill bit head having a drill bit sector coaxial with the bit and largely on one side of the axis thereof for drilling an enlarged hole upon rotation of the bit, the drive shank having means, which includes the front section of external splines, for coaxially positioning the drive shank in the retracted, working position of the bit and means, which includes the rear reduced section of the drive shank, for permitting lateral movement of the drive shank in an extended, non-working position of the bit, thereby to permit the drill bit sector to swing inwardly.

12. A downhole hammer bit according to claim 11 wherein said rear reduced section of the drive shank comprises a rear section of external splines having a size less than the front section of external splines.

13. A downhole hammer bit according to claim 11 wherein the drive shank has an enlarged rear end section with a front, generally annular shoulder for supporting the bit in its extended non-working position, the front generally annular shoulder having an axis inclined to the axis of the bit in the direction of the drill bit sector for supporting the bit at an angle at which the drill bit sector is radially inward of its working position.

14. A downhole hammer impact bit according to claim 11 wherein the drive shank comprises an enlarged front generally cylindrical section between the impact head and front section of external splines for assisting in coaxially positioning the bit in its withdrawn working position.

15. For use in a downhole impact hammer, a subassembly comprising a drill bit chuck having an axial bore, with an annular arrangement of internal splines, and front and rear end faces at the opposite axial ends thereof, a drill bit having a front enlarged drill bit head and a rear elongated drive shank with a rear anvil end face adapted to be impacted for downhole drilling, the bit drive shank being slidably received in the axial bore of the chuck for axial movement of the drill bit between a retracted, working position with the enlarged drill head in engagement with the front end face of the chuck and an extended, non-working position with the drill bit supported on the rear end face of the chuck, and removable retaining ring means mounted on the rear end of the drive shank to engage the rear end face of the chuck to support the drill bit thereon, the drive shank having a front section of external splines which cooperate with the internal splines of the chuck to provide, with the drill bit in its retracted, working position, a drive coupling for rotation of the bit, the drill bit head having a drill bit sector coaxial with the drill bit and largely on one side of the axis thereof, and operable with the drill bit in its retracted working position and upon rotation of the bit, for drilling a hole, the drive shank and chuck having cooperating means for positioning the bit coaxially within the chuck in the retracted, working position of the bit and cooperating means for permitting lateral movement of the drive shank within the chuck in the extended, non-working position of the bit, thereby to permit the drill bit sector to swing inwardly to reduce the diameter of the drill bit head envelope.

16. A subassembly according to claim 15 wherein the drive shank comprises a front generally cylindrical section, between the drill bit head and front section of external splines, having a diameter greater than that of the front section of external splines and wherein the axial bore of the chuck comprises an enlarged front bore section for receiving said front generally cylindrical section of the drive shank, with the drill bit in its retracted working position, for assisting in positioning the bit coaxially within the chuck.

17. A subassembly according to claim 15 wherein the subassembly comprises angled support means for supporting the drill bit on the rear end face of the chuck at an angle at which the drill bit sector is radially inward of its working position to reduce the diameter of the drill bit head envelope.

18. A subassembly according to claim 17 wherein the angled support means comprises an annular support shoulder on the rear end of the drive shank having an axis inclined to the axis of the bit for supporting the drill bit at said angle.

19. A subassembly according to claim 17 wherein the angled support means comprises an annular support shoulder on the retaining ring means having an axis inclined to the axis of the bit for supporting the drill bit at said angle.

* * * * *